US007012500B2

(12) United States Patent
Chan et al.

(10) Patent No.: US 7,012,500 B2
(45) Date of Patent: Mar. 14, 2006

(54) GFCI WITH ENHANCED SURGE SUPPRESSION

(75) Inventors: David Y. Chan, Bellerose, NY (US); Roger M. Bradley, North Bellmore, NY (US); John J. Power, Westbury, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/804,510

(22) Filed: Mar. 19, 2004

(65) Prior Publication Data

US 2005/0206493 A1 Sep. 22, 2005

(51) Int. Cl.
*H01C 7/10* (2006.01)

(52) U.S. Cl. ..... 338/20; 338/21; 361/127

(58) Field of Classification Search ..... 338/20, 338/21; 362/125, 127

See application file for complete search history.

(56) References Cited

U.S. PATENT DOCUMENTS

| | | | | |
|---|---|---|---|---|
| 5,208,723 | A * | 5/1993 | Jenne | 361/119 |
| 5,210,676 | A * | 5/1993 | Mashikian | 361/117 |
| 5,901,027 | A * | 5/1999 | Ziegler et al. | 361/124 |
| 6,094,128 | A * | 7/2000 | Bennett et al. | 338/21 |
| 6,211,770 | B1 * | 4/2001 | Coyle | 338/21 |
| 6,462,318 | B1 * | 10/2002 | Furuuchi et al. | 219/517 |
| 2001/0015686 | A1 * | 8/2001 | McLoghlin | 338/21 |
| 2001/0055187 | A1 * | 12/2001 | McLoughlin et al. | 361/127 |

* cited by examiner

*Primary Examiner*—Karl D. Easthom
(74) *Attorney, Agent, or Firm*—Paul J. Sutton

(57) ABSTRACT

An MOV element is physically and electrically connected to a heat sensitive material which changes from a low impedance path to a high impedance path, such as a spark gap, when the temperature of the MOV element rises to a temperature below that at which the MOV will enter into its thermal runaway state. More specifically, the heat sensitive material is located on a surface of the MOV and is electrically connected in series with the MOV. In operation, as the MOV gets hot, it heats the heat sensitive material. As the heat sensitive material gets hot, it starts to separate from the surface of the MOV to form a spark gap which is electrically connected in series with the MOV element to help dissipate excessive voltage. The heat sensitive material on the surface of the MOV element can be a coating of epoxy which cracks and/or breaks away, at least partially from the surface of the MOV element during the occurrence of a high voltage transient surge, or it can be a solder that sputters to form an arc path during the occurrence of a high voltage transient surge. In operation, when a GFCI is subjected to a high voltage transient surge above a certain magnitude, the heat sensitive material forms a spark gap which is in series with the MOV and prevents the GFCI from going into its destructive thermal runaway condition. Thus, prior to the MOV entering its thermal runaway state, it goes from being only an MOV to an MOV in series with a spark gap which can be used to protect an up stream GFCI during the occurrence of a high voltage transient surge.

11 Claims, 15 Drawing Sheets

224
212

210
221
214
222
220
230
RESET
218
216
232
236
228
TEST
234
221
226
220
222

224
230
RESET
114
112
110
120
120
102
100
226
TEST
100
102
118
272
238
282
270
260
258
280
278
240
254
236
264
260
274
284
116
234
252
262
296
296
298
298
293
294
292
250

GFCI WITH ENHANCED SURGE SUPPRESSION

BACKGROUND OF THE INVENTION

1. Field of the Invention

The present invention relates generally to metal oxide varistors and, more particularly, to a metal oxide varistor that can modify its operating characteristics to protect a ground fault circuit interrupter during the occurrence of an overload voltage surge.

2. Description of the Prior Art

A high voltage transient surge can totally or partially damage electrical devices such as Ground Fault Circuit Interrupters (GFCIs) located in homes, factories and commercial buildings. In many instances the damage can cause only the protective features of the GFCIs to become either partially or fully inoperative while the device itself continues to conduct electricity. For example, it is not uncommon for the contacts of a GFCI which was subjected to a high voltage transient surge to be fused together and continue to conduct current even while the protective features of the GFCI are no longer operational.

A need exists for a device which can protect loads from short term over-voltage conditions. One class of devices which can be used to protect the GFCI from an over-voltage condition is known as Metal Oxide Varistors (MOVs). In operation, an MOV is connected in parallel with the device that is to be protected such as a GFCI. At low voltages the MOV has a very high resistance. At high voltages, the varistor has a very low resistance so that when a high voltage transient surge appears on the power supply line, the MOV, which appears as a low resistance, prevents the transient voltage surge from reaching the device. Conduction through an MOV begins when the voltage across the MOV reaches a maximum continuous operating voltage, referred to as the varistor voltage. As the voltage increases, the MOV's resistance drops rapidly and may approach zero. Because the resistance of the MOV decreases as the voltage increases, the MOV diverts transient current through itself and not through the device that is connected in parallel with and up stream of the MOV. After the occurrence of the voltage transient surge, the MOV returns to its normal high resistance state and is ready for the next high voltage surge.

Another characteristic of an MOV is that during operation, the MOV will increase in temperature as it conducts high voltage surges. If the voltage surges are well spaced, the MOV can cool down between events. However, if the events are closely spaced, the MOV will not have enough time to cool down and this heating of the MOV will allow additional current to flow through the MOV. The additional current will further raise the temperature of the MOV, and this will continue until the MOV destroys itself. This condition is known as thermal runaway. When in its thermal runway state, an MOV can explode and possibly cause extensive damage to surrounding components, a fire hazard and/or injury.

One way of protecting the MOV itself is with a thermal protection device wired in parallel with and located to be heated by the MOV element. The melting point of the thermal protection device is set to be at a temperature below that which will cause the MOV to enter its thermal runaway state. As the temperature of the MOV rises, a point will be reached where the thermal protection device will melt and disconnect the MOV from the load. When the load is a GFCI, it will no longer be protected by the MOV and the full impact of the high voltage transient pulse will be applied to the GFCI. Thus, when an overload condition occurs, the over voltage transient surge is free to destroy the GFCI that was being protected.

What is needed is an MOV which can protect a GFCI during an overload voltage surge.

The peak surge current rating of an MOV is a function of the area of the disc itself. To protect a GFCI from destructive high voltage transient surges, test have shown that an MOV of at least 20 mm is needed. Unfortunately, it is not possible to connect an MOV of this size to a GFCI and still fit the GFCI and the MOV into a single outlet box.

What is also needed is an MOV which, when connected to a GFCI, is small enough to fit within a single outlet box.

SUMMARY OF THE INVENTION

An MOV element is physically and electrically connected to a heat sensitive material which changes from a low impedance path to a high impedance path, such as a spark gap, when the temperature of the MOV element rises to a temperature below that at which the MOV will enter into its thermal runaway state. More specifically, the heat sensitive material is located on a surface of the MOV and is electrically connected in series with the MOV. In operation, as the MOV gets hot, it heats the heat sensitive material. As the heat sensitive material gets hot, it starts to separate from the surface of the MOV to form a spark gap which is electrically connected in series with the MOV element to help dissipate excessive voltage. The heat sensitive material on the surface of the MOV element can be a coating of epoxy which cracks and/or breaks away, at least partially from the surface of the MOV element during the occurrence of a high voltage transient surge, or it can be a solder that sputters to form an arc path during the occurrence of a high voltage transient surge. In operation, when a GFCI is subjected to a high voltage transient surge above a certain magnitude, the heat sensitive material forms a spark gap which is in series with the MOV and prevents the GFCI from going into its destructive thermal runaway condition. Thus, prior to the MOV entering its thermal runaway state, it goes from being only an MOV to an MOV in series with a spark gap which can be used to protect an up stream GFCI during the occurrence of a high voltage transient surge.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the sprit and scope of the invention in its broadest form.

BRIEF DESCRIPTION OF THE DRAWINGS

Other aspects, features and advantages of the present invention will become more fully apparent form the following detailed description, the appended claim and the accompanying drawings in which:

DETAILED DESCRIPTION OF THE INVENTION

Figure 1:
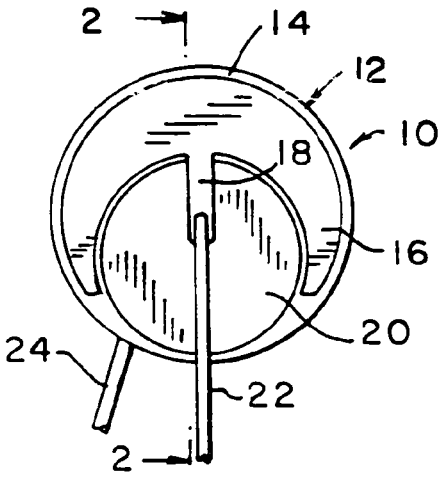
FIG. 1 is a front elevation view of a first embodiment of an MOV device in accordance with the principles of the invention.
Figure 2:
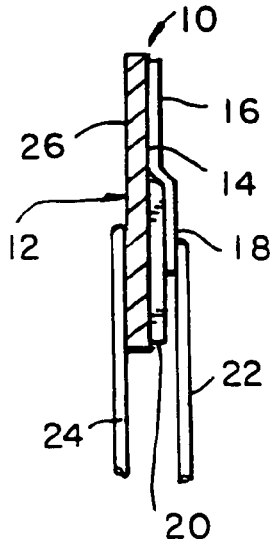
FIG. 2 is a side elevation view, partly in section, of the device of FIG. 1, taken along the line 2—2.

Referring to FIGS. 1 and 2, a first embodiment of a thermal protection device 10 constructed in accordance with the principles of the invention is shown. A layer of thermal fusible material 16 which is thermally sensitive and electrically conductive is placed on one face 14 of an MOV disc 12. A heat sensitive thermosetting material, such as an epoxy resin, which is readily available in granular or powder form and is a rigid solid when heated and cured in the normal manner can be used. The thermal fusible material 16 can be attached to face 14 of the MOV element, shown as the disc 12, by adhesives, bonding or the like. The heat sensitive material 16 converts from a low impedance conductive path to a spark gap with the surface of the MOV element increases to a temperature which is less than that which will cause MOV 12 failure. The layer of heat sensitive material 20 is of electrically conductive material suitable for high temperature operation and is heated by the MOV when the MOV is shunting an over voltage. The heat sensitive material can also be a ceramic or a solder. A connection tail 18 of the thermal fusible material layer 16 extends over the top of insulation layer 20 where it can be easily connected to a first lead 22. A second lead 24 is connected to the other face 26 of the MOV device 12.

Thermal energy due to a voltage surge through the MOV results in an increase in the temperature of the MOV. If voltage surges such as, for example, those due to the switching of power, etc. are well spaced, the MOV can cool down between the events. However, if the events are closely spaced the MOV does not have enough time to cool down and this heating of the MOV will allow more current to flow which will further raise the temperature of the MOV. This can continue until the MOV is destroyed by thermal runaway.

To prevent thermal runaway, the layer of thermal fusible material 16 is placed in intimate contact with face 14 of the MOV 12 and has a connection tail 18 to which is connected a lead 22. Current normally flows through the lead 24 to the face 26 of the MOV 12, the MOV 12 itself, the layer of material 16 to the connection tail 18 and the lead 22. If the current flowing through this circuit rises due to load switching, etc. to cause the MOV to heat up, the material 16 will also heat up, will form at least one crack, and will separate at least partially from the surface of the MOV. If the material is an epoxy or a ceramic it will crack, and if it is a solder it will melt. In each instance, the path to the connection tail 18 and the lead 22 will be a high resistance path such as a spark gap. The creation of the spark gap keeps the MOV in the circuit during the over voltage surge to provide protection to the load and, at the same time, protect the MOV from excessive heating which could cause it to fracture and explode.

Figure 3:
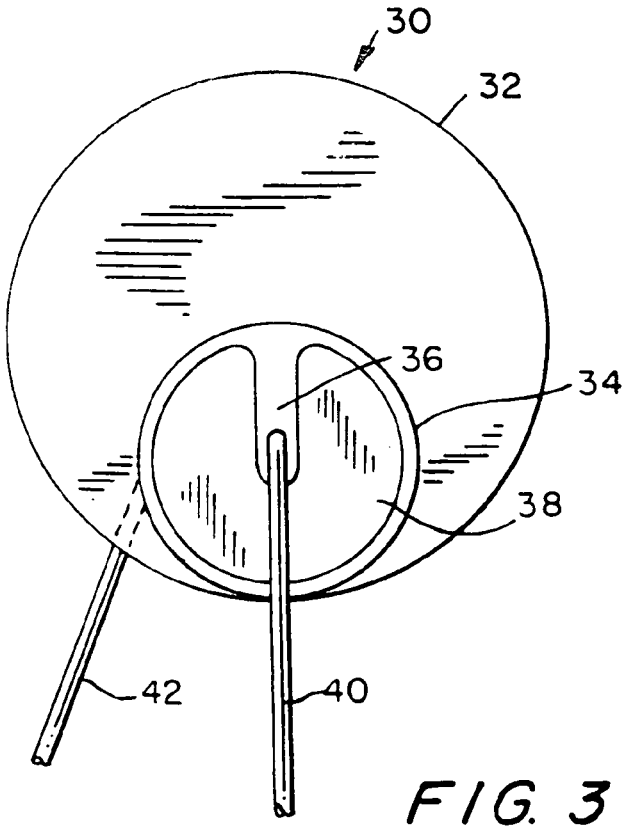
FIG. 3 is a front elevation view of another MOV device in accordance with the principles of the invention.

The material layer does not have to extend over the full face of an MOV. It can extend over a lesser portion of the face as is shown in FIGS. 3, 4, 7 and 8. Referring to FIG. 3, the front face of MOV 32 has a generally circular layer of heat sensitive material 34 having a diameter substantially equal to the radius of the MOV 32. A connection tail 36 extends outwardly over a circular layer of insulation 38. A conductor 40 is fastened to the connection tail 36 and a second conductor 42 is fastened to the other side of the MOV (not visible in the Fig.). The entire device is covered with a coating of heat sensitive material such as an epoxy or similar electrical insulation material except for the portion of conductors 40 and 42 that extend from MOV 32. The operation of the device 30 of FIG. 3 is the same as described above with respect to the device in FIGS. 1 and 2.

Figure 4:
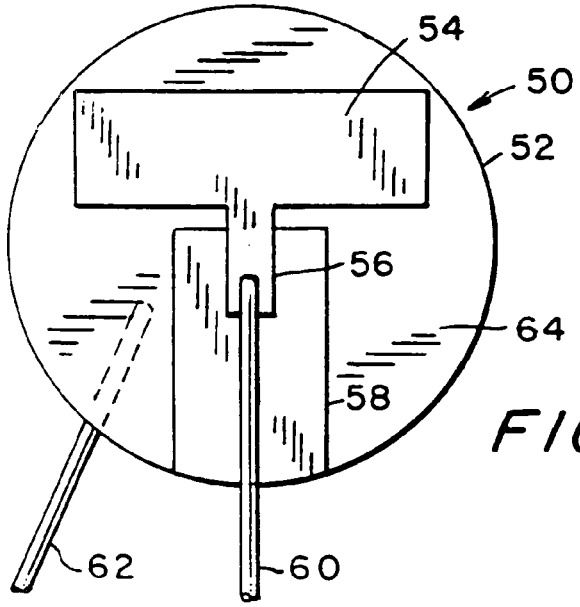
FIG. 4 is a front elevation view of another MOV device.
Figure 7:
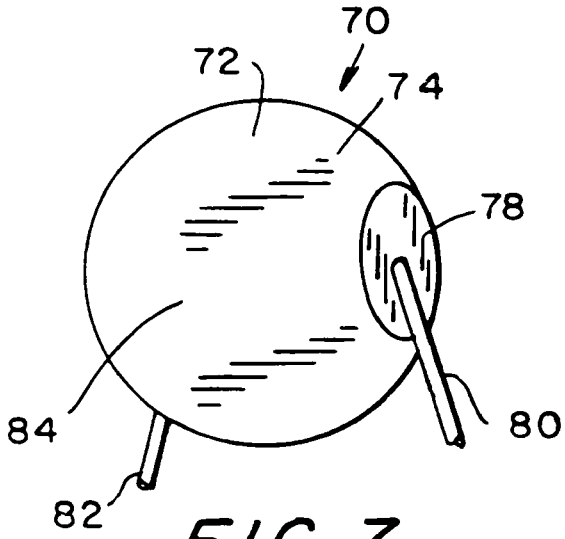
FIG. 7 is a front elevation view of a further embodiment of the MOV device.
Figure 8:
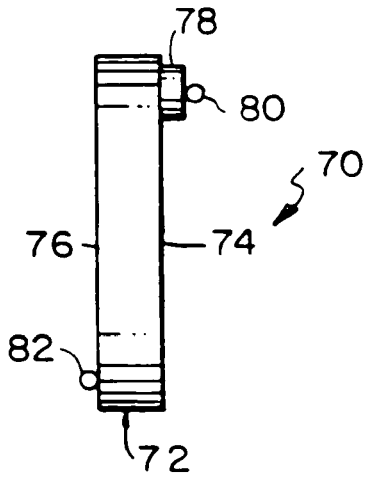
FIG. 8 is a top plan view of the device of FIG. 7.

Referring to FIG. 4, one surface of the MOV 52 has placed thereon a layer of heat sensitive material 54 in the general shape of a rectangle. A connection tail 56 extends over a thick layer of insulation 58 and is coupled to a conductor 60. A second conductor 62 is coupled to the opposite face of MOV 52 (not visible in the Fig.). The remainder of the face 64 of the MOV 52 is covered with a coating of Epoxy or other similar material applied at the factory. FIGS. 7 and 8 show a device 70 where the material 78 occupies only a portion of face 74 of the MOV 72. The difference in this embodiment over those of FIGS. 1 to 4 is that the conductor 80 is coupled directly to the heat sensitive material layer 78 without the use of an intermediate connection tail. Conductor 82 is coupled directly to the rear face 76 of the MOV 72 element and the entire device is covered with a coating of insulation (not shown) such as epoxy or similar material except for the portion of conductors 80 and 82 that extend from MOV 72. The operation of the devices 50 and 70 are the same as that described above with respect to device 10 of FIGS. 1 and 2.

Figure 5:
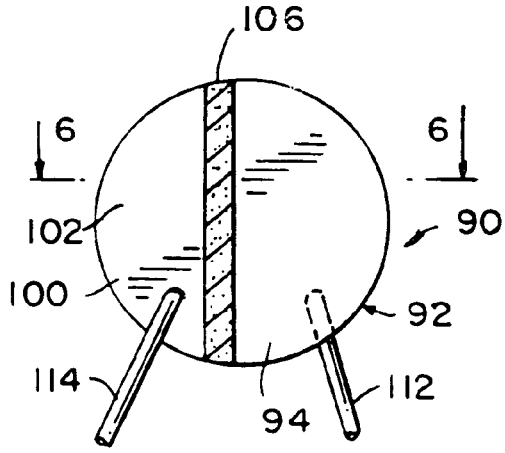
FIG. 5 is a front elevation view of still another MOV device with its insulating layer remover to show the components of the MOV device.
Figure 6:
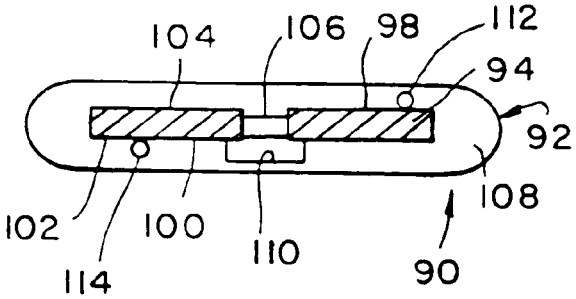
FIG. 6 is a top plan view of the device of FIG. 5 taken along the line 6—6.

Referring to FIGS. 5 and 6, a further embodiment of device 90 is shown. The MOV 92 is made up of two halves 94 and 100 which are joined and spanned by a region of heat sensitive material 106. A conductor 112 is coupled directly to rear face 98 of half 94 and a second conductor 114 is directly coupled to front face 102 of half 100. The layer of insulation 108 (not shown in FIG. 5 to provide a better understanding of the device 90) completely surrounds the device 90, except for conductors 112 and 114 which extend from the MOV 92 and gap 110 and exists adjacent the heat sensitive material 106. The gap 110 permits the run-off of heat sensitive layer as set froth above and any gases, produced when the material melts, to escape. With the heat sensitive material 106 in place a complete electrical path through the MOV 92 exists. The path goes from conductor 112 to MOV half 94, through material 106 to MOV half 100 and conductor 114. When the band of material 106 melts, the path between the halves 94 and 100 is opened to create a spark gap.

What is disclosed above is a new improved Metal Oxide Varistor that can change its mode of operation from operating only as an MOV to operating as an MOV in series with a spark gap to provide continuous over voltage protection to a load such as a GFCI during the occurrence of a voltage transient surge having a magnitude that can be sufficiently large to destroy the MOV.

Under normal operating conditions the MOV here disclosed operates as all MOVs operate to pass voltage spikes which do not exceed the design parameters of the MOV. But, when the MOV is subjected to one or more high voltage occurrences which exceed the design parameters of the MOV and which can destroy the MOV, the material, which can be a ceramic, an epoxy or a solder will allow a lead to separate from the MOV element but still stay intact to form a high resistance path such as a spark gap for the high voltage surge. When this occurs the MOV transforms itself from being only an MOV to being an MOV in series with a spark gap to prevent the MOV from destroying itself, and the MOV continues to remain in the circuit and clamp the transient voltage during the occurrence of the over voltage.

It is to be noted that the peak surge current rating of an MOV is a function of the area of the disc itself. Therefore, where stringent space requirements are such that an MOV which will satisfy the requirements of a circuit is too large to allow a GFCI with an MOV to be placed within a single outlet box, it is now possible with this invention to use a smaller diameter MOV which, in combination with a GFCI, can now be fitted into a single outlet box.

Ground Fault Circuit Interrupters (GFCIs) are normally connected to protect receptacles from various faults and are, themselves, subject to high voltage transients surges that are carried on the incoming power lines. In addition, GFCIs are normally located in a single outlet box where space is at a premium. In an attempt to use an MOV to protect a GFCI from destructive high voltage transient surges, tests showed that an MOV of at least 20 mm is needed. Unfortunately, it is not possible to connect an MOV of this size to a GFCI and still fit the GFCI and MOV into a single outlet box. But, by using an MOV constructed in accordance with the principles of the invention as disclosed above, an MOV with a diameter of only 7 mm can be substituted for the now required 20 mm MOV, and it was found that the 7 mm MOV here disclosed can sustain a surge of 6 thousand volt at 3 thousand amperes. Now, for the first time, using the new MOV here disclosed, an MOV can be connected in parallel with and upstream of a GFCI to protect the GFCI against high voltage transient surges and still be located in a single outlet box.

A description of a GFCI which can be used in combination with the MOV here disclosed follows.

The MOV disclosed above can be connected to protect Ground Fault Circuit Interrupter (GFCI) devices, such as the GFCI receptacle described in commonly owned U.S. Pat. No. 4,595,894, which uses an electrically activated trip mechanism to mechanically break an electrical connection between one or more input and output conductors. Such devices can be reset after they are tripped by, for example, the detection of a circuit fault. In the device discussed in the '894 patent, the trip mechanism used to cause the mechanical breaking of the circuit i.e., the conductive path between the line and load sides, includes a solenoid or trip coil. A test button is used to test the trip mechanism and circuitry used to sense faults, and a reset button is used to reset the electrical connection between line and load sides.

However, instances may arise where an abnormal condition caused by, for example, circuit switching or the like may result not only in a surge of electricity and a tripping of the device, but also a disabling of the trip mechanism used to cause the mechanical breaking of the circuit. This can occur without the knowledge of the user. Under such circumstances an unknowing user, faced with a GFCI which has tripped, may press the reset button which, in turn, will cause a device with an inoperative trip mechanism to be reset without ground fault protection being available.

Further, an open neutral condition, which is defined in Underwriters Laboratories (UL) Standard PAG 943A, may exist where the open neutral condition is on the line (verses load) side of the GFCI device to create a current path which can extend from the phase (or hot) wire supplying power to the GFCI device through the load side of the device to a person.

Commonly owned U.S. Pat. No. 6,040,967, which is incorporated herein in its entirety by reference, describes a family of resettable circuit interrupting devices capable of locking out the reset portion of the device if the circuit interrupting portion is non-operational or if an open neutral condition exists.

Some of the circuit interrupting devices described above have a user accessible load side connection in addition to the line and load side connections. The user accessible load side connection includes one or more connection points where a user can externally connect to electrical power supplied from the line side. The load side connection and user accessible load side connection are typically electrically connected together. An example of such a circuit interrupting device is a GFCI receptacle, where the line and load side connections are binding screws and the user accessible load side connection is the plug connection to an internal receptacle. As noted, such devices are connected to external wiring so that line wires are connected to the line side connection and load side wires are connected to the load side connection. However, instances may occur where the circuit interrupting device is improperly connected to the external wires so that the load wires are connected to the line side connection and the line wires are connected to the load side connection. This in known as reverse wiring. In the event the circuit interrupting device is reverse wired, fault protection to the user accessible load connection may not be present, even if faulty protection to the load side connection remains. Commonly owned application Ser. No. 09/812,288 filed Mar. 20, 2001, which is incorporated herein in its entirety by reference describes a resettable circuit interrupting device that maintains fault protection for the circuit interrupting device even in those instances where the device is reverse wired.

While the devices identified above are configured to open the conductive path upon the occurrence of ground faults, immersion detection faults, appliance leakage faults, equipment leakage faults, reverse wiring faults and the like, they cannot meet the stringent requirements that are imposed on Transient Voltage Surge Suppression (TVSS) products. What is needed is a Ground Fault Circuit Interrupter having Enhanced Surge Suppression and still fit within a single outlet box.

The present application contemplates various types of circuit interrupting devices that are capable of breaking at least one conductive path at both a line side and a load side of the device when an overload high voltage surge occurs. The conductive path is typically divided between a line side that connects to supplied electrical power and a load side that connects to one or more loads. As noted, the various devices in the family of resettable circuit interrupting devices include: ground fault circuit interrupters (GFCI's), immersion detection circuit interrupters (IDCI's), appliance leakage circuit interrupters (ALCI's) and equipment leakage circuit interrupters (ELCI's).

For the purpose of the present application, the structure or mechanisms for protecting a GFCI in response to an overload voltage surge condition can be incorporated within and made a part of any of the various devices in the family of resettable circuit interrupting devices such as GFCI's shown in the drawings and described below.

The GFCI receptacles described herein have line and load phase (or power) connections, line and load neutral connections and user accessible load phase and neutral connections. The connections permit external conductors or appliances to be connected to the device. These connections may be, for example, electrical fastening devices that secure or connect external conductors to the circuit interrupting device, as well as conduct electricity. Examples of such connections include binding screws, lugs, terminals and external plug connections.

In one embodiment, the GFCI receptacle has a circuit interrupting portion, a reset portion and a reset lockout. This embodiment is shown in FIGS. 9–19. In another embodiment, the GFCI receptacle is similar to the embodiment of FIGS. 9–19, except the reset lockout can be omitted. Thus, in this embodiment, the GFCI receptacle has a circuit interrupting portion and a reset portion, which is similar to those described in FIGS. 9–20. In another embodiment, the GFCI receptacle has a circuit interrupting portion, a reset portion, a reset lockout and an independent trip portion (not illustrated).

The circuit interrupting and reset portions described herein can use electromechanical components to break (open) and make (close) one or more conductive paths between the line and load sides of the device. However, electrical components, such as solid state switches and supporting circuitry may be used to open the close the conductive paths.

Generally, the circuit interrupting portion is used to automatically break electrical continuity in one or more conductive paths i.e., open the conductive path, between the line and load sides upon the detection of a fault, which in the embodiments described is a ground fault. The reset portion is used to close the open conductive paths.

In the embodiments including a reset lockout, the reset portion is used to disable the reset lockout, in addition to closing the open conductive paths. In this configuration, the operation of the reset and reset lockout portions is in conjunction with the operation of the circuit interrupting portion, so that electrical continuity in open conductive paths cannot be reset if the circuit interrupting portion is non-operational, if an open neutral condition exists and/or if the device is reverse wired.

In the embodiments including an independent trip portion, electrical continuity in one or more conductive paths can be broken independently of the operation of the circuit interrupting portion. Thus, in the event the circuit interrupting portion is not operating properly, the device can still be tripped.

The above described features can be incorporated in any resettable circuit interrupting device, but for simplicity the descriptions herein are directed to GFCI receptacles.

Figure 9:
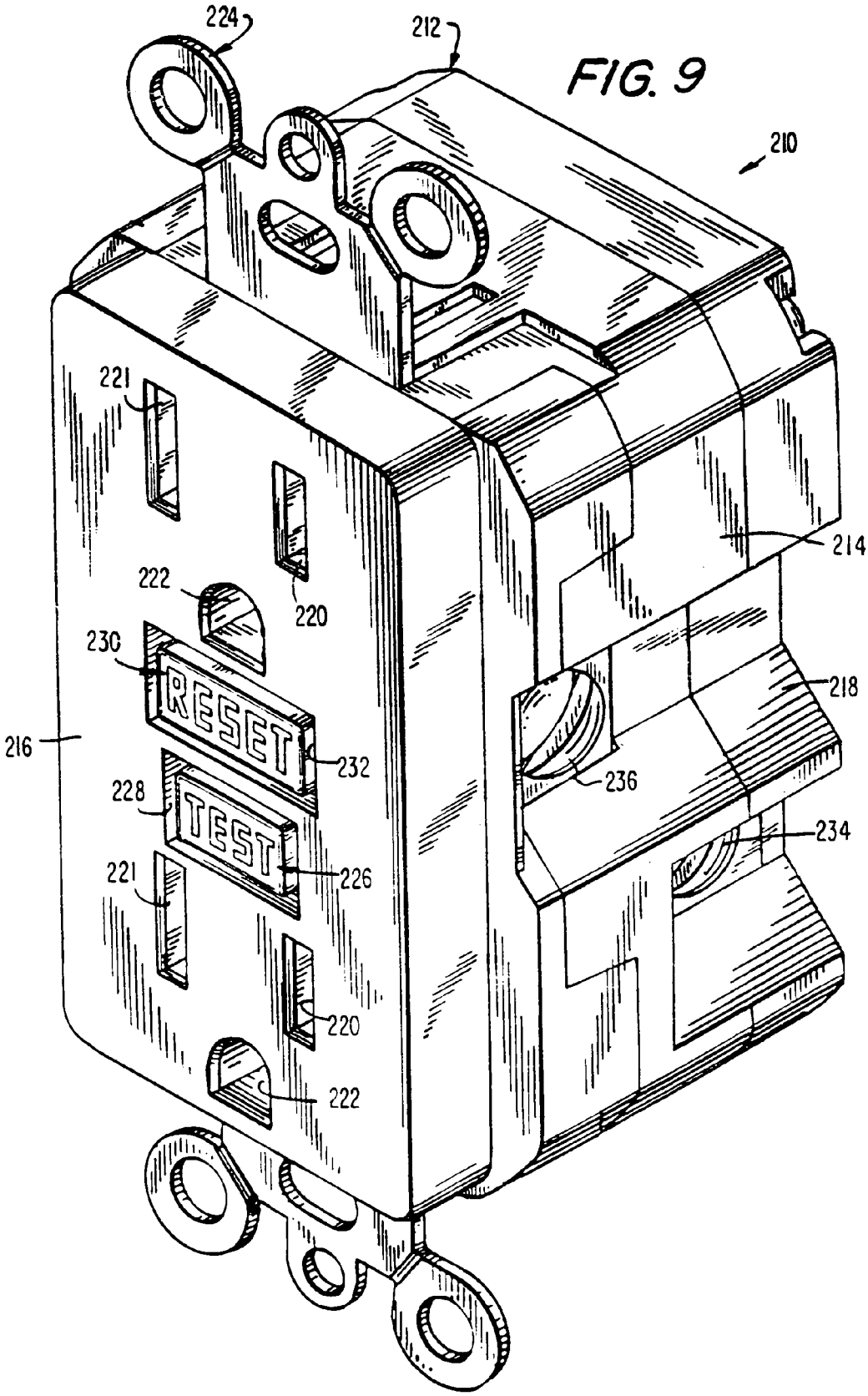
FIG. 9 is a perspective view of one embodiment of a ground fault circuit interrupting device having an internally located MOV surge protection device according to the present application.

Turning now to FIG. 9, the GFCI receptacle 210 has a housing 212 consisting of a relatively central body 214 to which a face of cover portion 216 and a rear portion 218 are removably secured. The face portion 216 has entry ports 220 and 221 for receiving normal or polarized prongs of a male plug of the type normally found at the end of a lamp or appliance cord set (not shown), as well as ground prong receiving openings 222 to accommodate a three wire plug. The receptacle also includes a mounting strap 224 used to fasten the receptacle to a junction box.

A test button 226 extends through opening 228 in the face portion 216 of the housing 212. The test button is used to activate a test operation, that tests the operation of the circuit interrupting portion (or circuit interrupter) disposed in the device. The circuit interrupting portion, to be described in more detail below, is used to break electrical continuity in one or more conductive paths between the line and load side of the device. A reset button 230 forming a part of the reset portion extends through opening 232 in the face portion 216 of the housing 212. The reset button is used to activate a reset operation, which reestablishes electrical continuity in the open conductive paths.

Electrical connections to existing household electrical wiring are made via binding screws 234 and 236, where screw 234 in as input or line phase connection, and screw 236 is an output or load phase connection. It should be noted that two additional binding screws 238 and 240 (see FIG. 3) are located on the opposite side of the receptacle 210. These additional binding screws provide line and load neutral connections, respectively. A more detailed description of a GFCI receptacle is provided in U.S. Pat. No. 4,595,894, which is incorporated herein in its entirety by reference. It should also be noted that binding screws 234, 236, 238 and 240 are exemplary of the types of wiring terminals that can be used to provide the electrical connections. Examples of other types of wiring terminals include a set screws, pressure clamps, pressure plates, push in type connections, pigtails and quick connect tabs.

Referring to FIGS. 10–14, the conductive path between the line phase connection 234 and the load phase connection 236 includes contact arm 250 which is movable between stressed and unstressed positions, movable contact 252 mounted to the contact arm 250, contact arm 254 secured to or monolithically formed into the load phase connection 236 and fixed contact 256 mounted to the contact arm 254. The user accessible load phase connection for this embodiment includes terminal assembly 258 having two binding terminals 260 which are capable of engaging a prong of a male plug inserted there between. The conductive path between the line phase connection 234 and the user accessible load phase connection includes, contact arm 250, movable contact 262 mounted to contact arm 250, contact arm 264 secured to or monolithically formed into terminal assembly 258, and fixed contact 266 mounted to contact arm 264. These conductive paths are collectively called the phase conductive path.

Similarly, the conductive path between the line neutral connection 238 and the load neutral connection 240 includes, contact arm 270 which is movable between stressed and unstressed positions, movable contact 272 mounted to contact arm 270, contact arm 274 secured to or monolithically formed into load neutral connection 240, and fixed contact 276 mounted to the contact arm 274. The user accessible load neutral connection for this embodiment includes terminal assembly 278 having two binding terminals 280 which are capable of engaging a prong of a male plug inserted there between. The conductive path between the line neutral connection 238 and the user accessible load neutral connection includes, contact arm 270, movable contact 282 mounted to the contact arm 270, contact arm 284 secured to or monolithically formed into terminal assembly 278, and fixed contact 286 mounted to contact arm 284. These conductive paths are collectively called the neutral conductive path.

Figure 10:
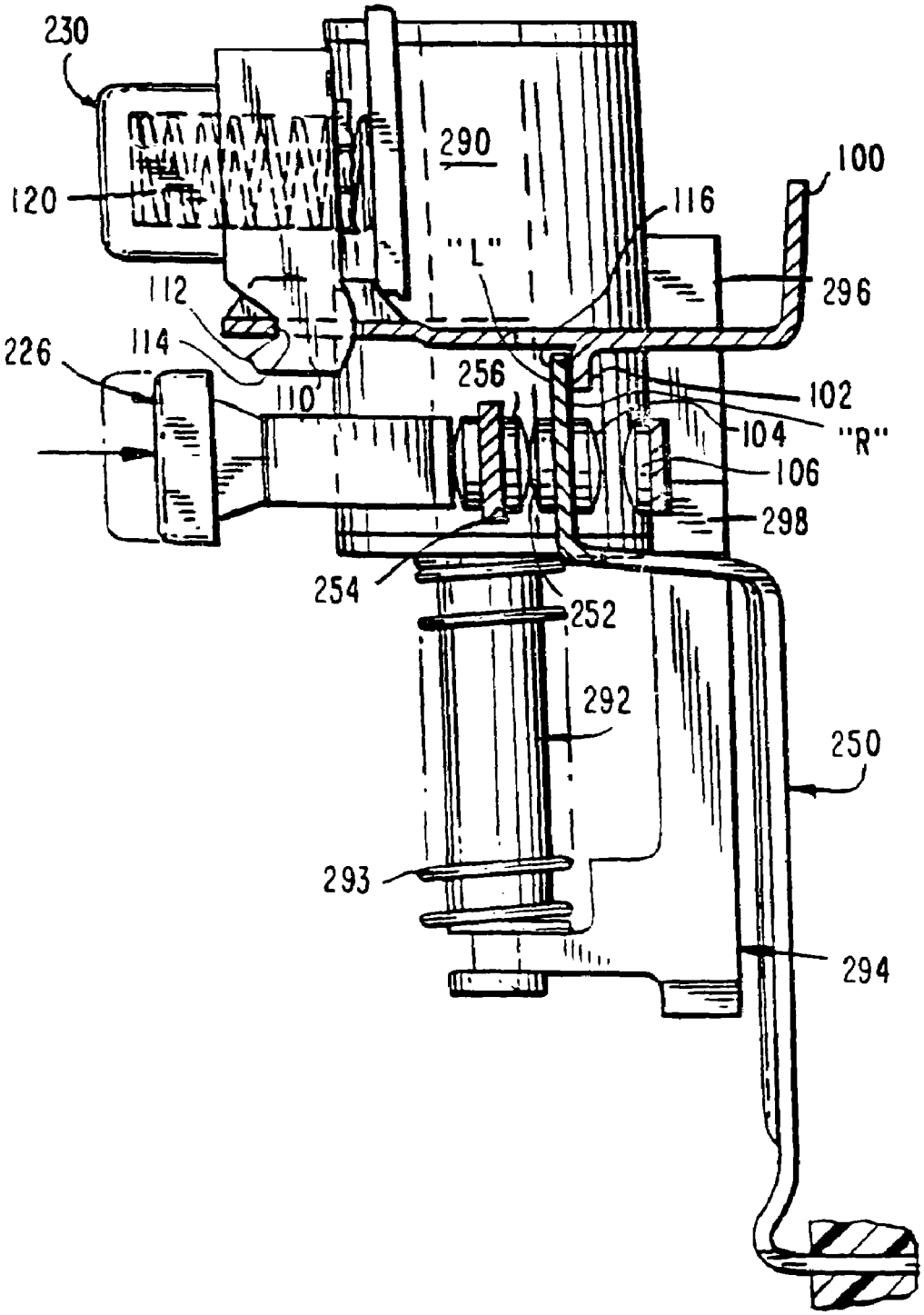
FIG. 10 is a side elevation view, partly in section, of a portion of the GFCI device shown in FIG. 9, illustrating the GFCI device in a set or circuit making position.
Figure 20:
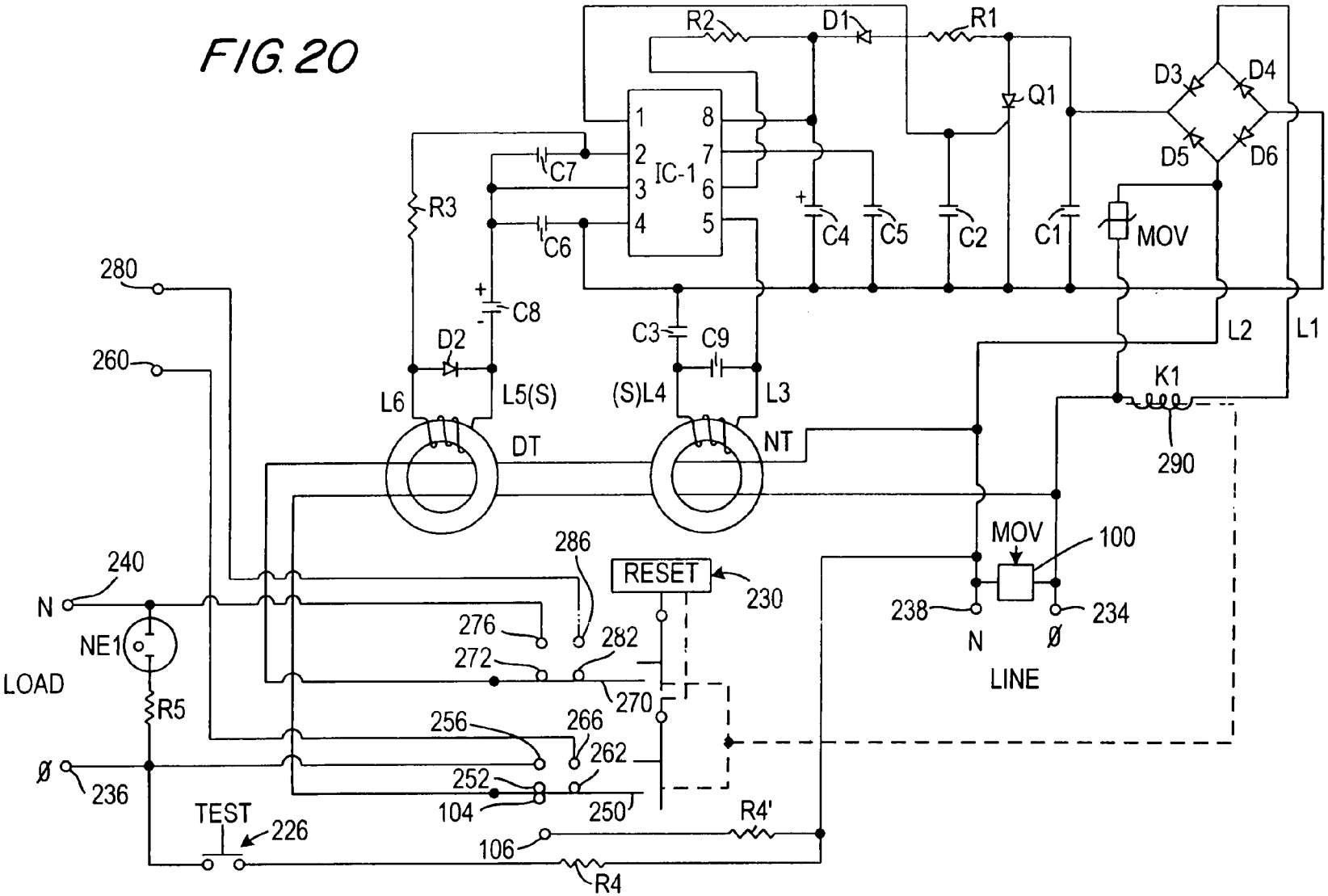
FIG. 20 is a schematic diagram of an MOV as herein disclosed connected in parallel with and up stream of a circuit for detecting faults.

Referring to FIG. 10, the circuit interrupting portion has a circuit interrupter and electronic circuitry capable of sensing faults, e.g., current imbalances, on the hot and/or neutral conductors. In the GFCI receptacle, the circuit interrupter includes a coil assembly 290, a plunger 292 responsive to the energizing and de-energizing of the coil assembly and a banger 294 connected to the plunger 292. The banger 294 has a pair of banger dogs 296 and 298 which interact with a movable latching member 100 used to set and reset electrical continuity in one or more conductive paths. The coil assembly 290 is activated in response to the sensing of a ground fault by, for example, the sense circuitry shown in FIG. 20. FIG. 20 shows circuitry for detecting ground faults that includes a differential transformer that senses current imbalances.

The reset portion includes a reset button 230, the movable latching members 100 connected to the reset button 230, latching fingers 102 and reset contacts 104 and 106 that temporarily activate the circuit interrupting portion when the reset button is depressed, when in the tripped position. Preferably, the reset contacts 104 and 106 are normally open momentary contacts. The latching fingers 102 are used to engage side R of each contact arm 250, 270 and move the arms 250, 270 back to the stressed position where contacts 252, 262 touch contacts 256, 266, respectively, and where contacts 272, 282 touch contacts 276, 286, respectively.

The movable latching members 102 are, in this embodiment, common to each portion, i.e., the circuit interrupting, reset and reset lockout portions, and used to facilitate making, breaking or locking out of electrical continuity of one or more of the conductive paths.

Figure 11:
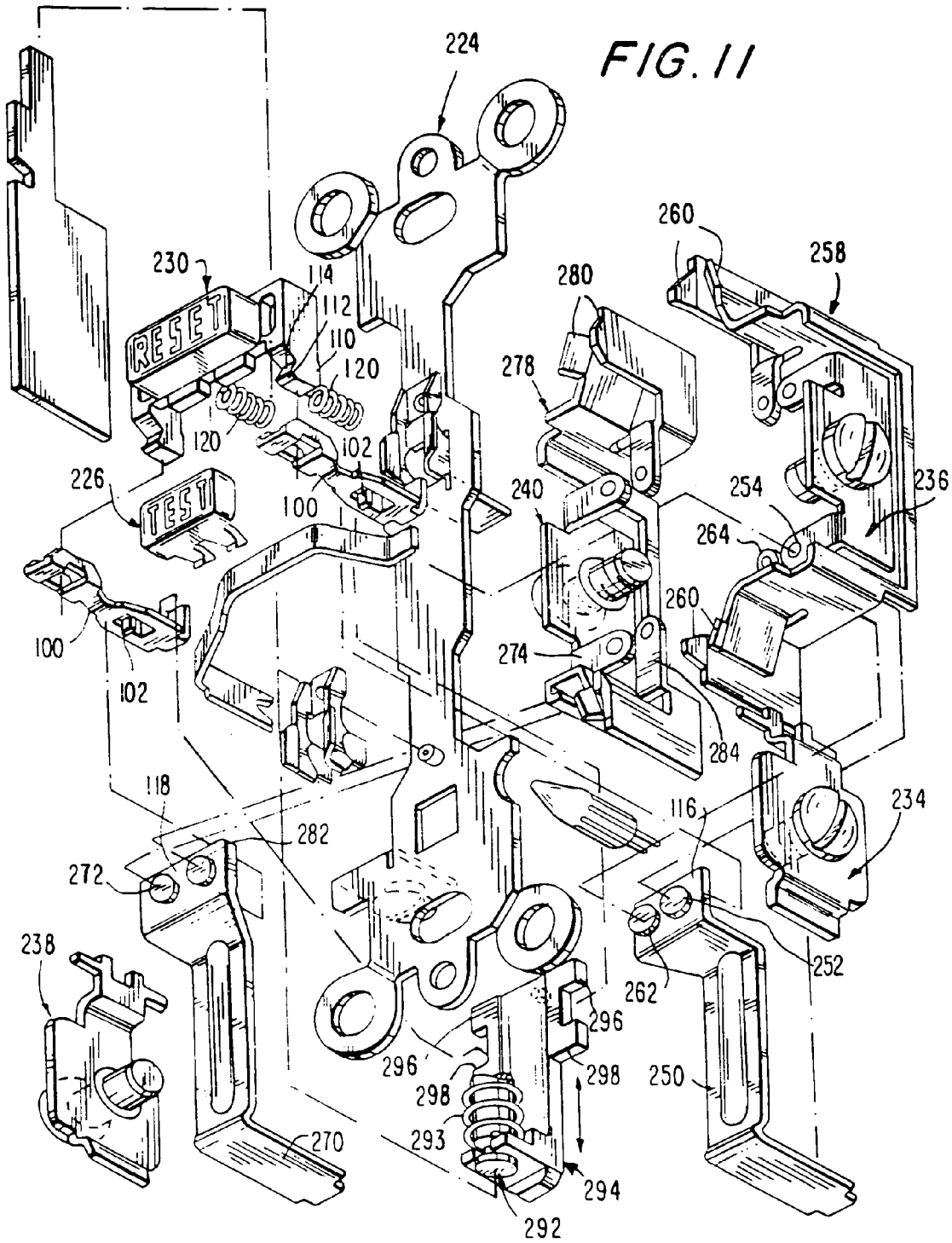
FIG. 11 is an exploded view of internal components of the circuit interrupting device of FIG. 9.
Figure 12:
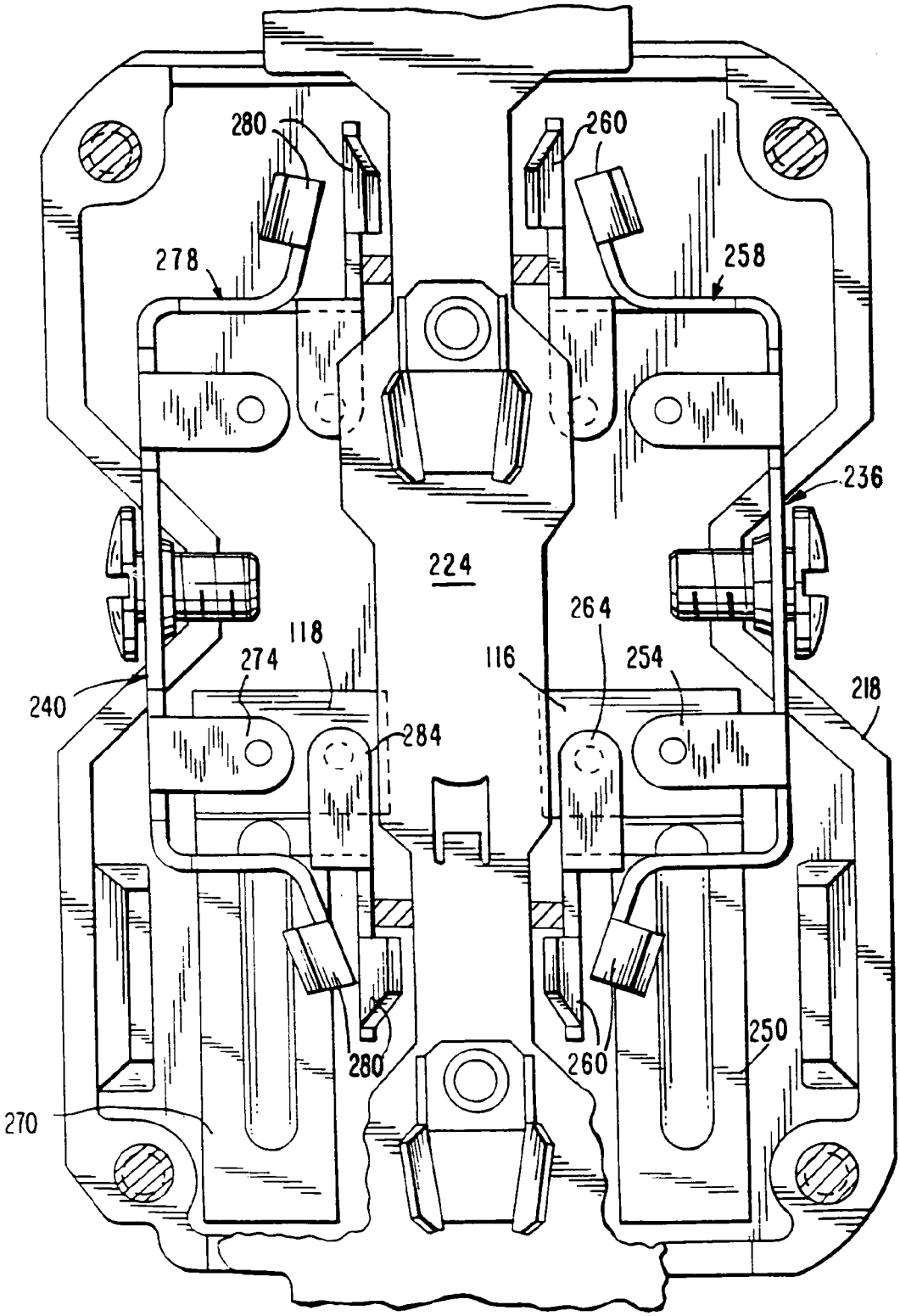
FIG. 12 is a plan view of portions of electrical conductive paths located within the GFCI device of FIG. 9 showing thermally conductive plastic coupled to the receptacle contacts.
Figure 13:
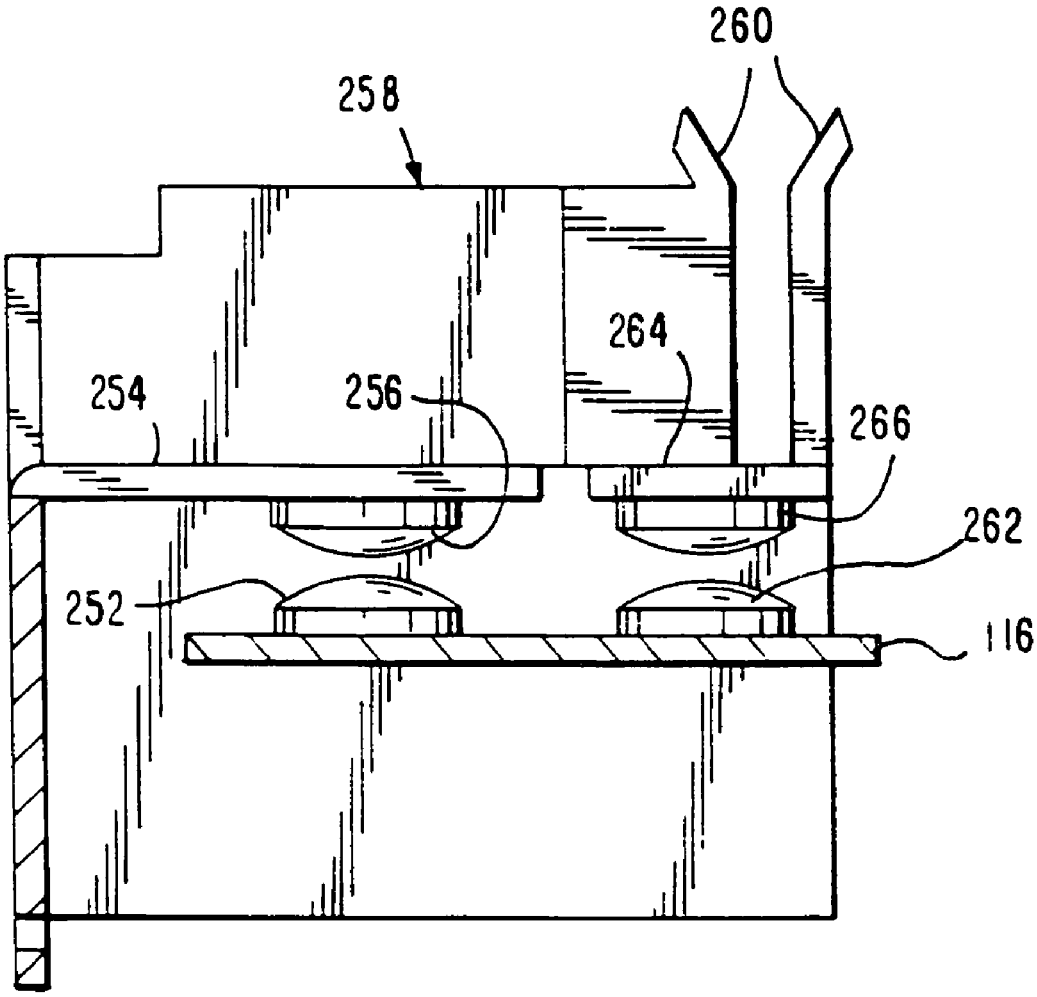
FIG. 13 is a partial sectional view of a portion of a conductive path shown in FIG. 12.
Figure 14:
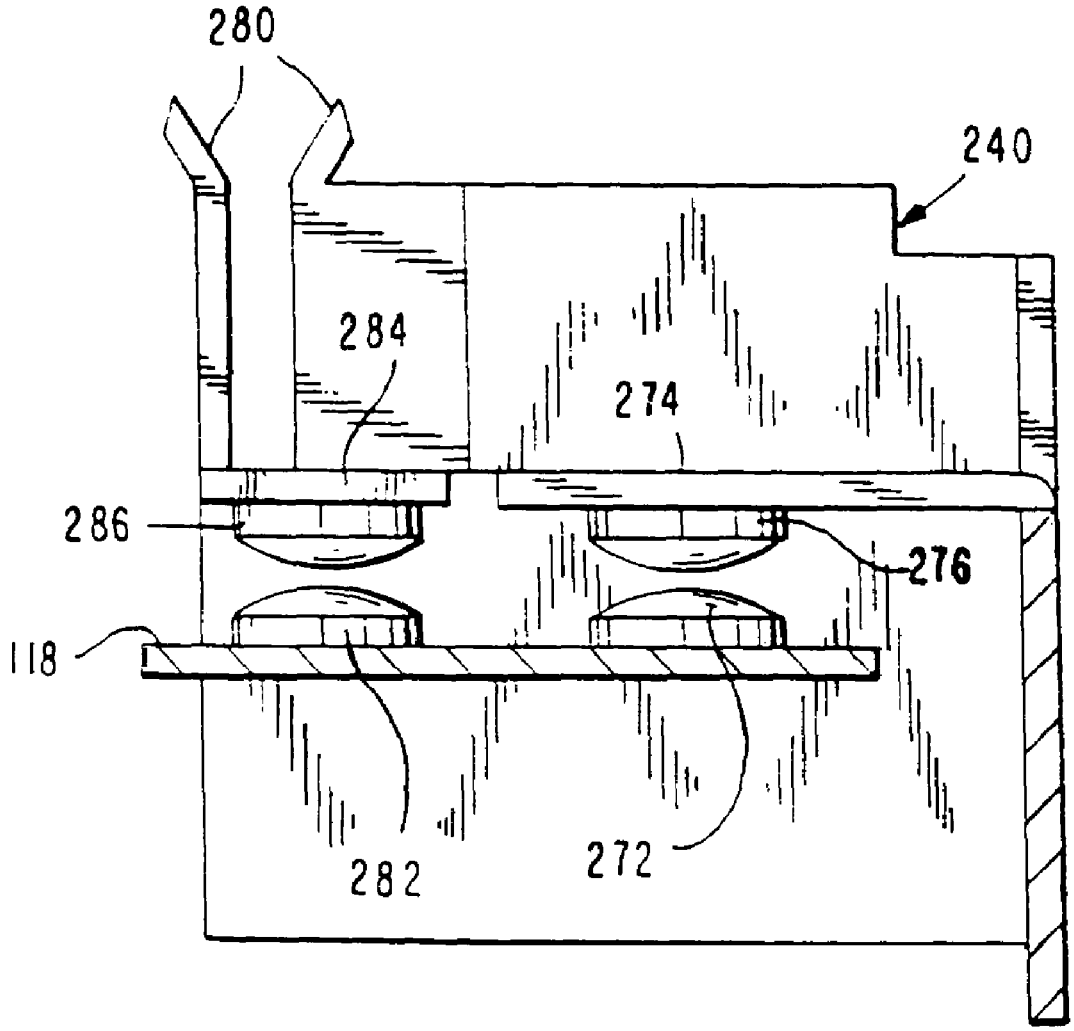
FIG. 14 is a partial sectional view of a portion of a conductive path shown in FIG. 12.

In the embodiment shown in FIGS. 10 and 11, the reset lockout portion includes latching fingers 102 which after the device is tripped, engages side L of the movable arms 250, 270 so as to block the movable arms 250, 270 from moving. By blocking movement of the movable arms 250, 270, contacts 252 and 256, contacts 262 and 266, contacts 272 and 276, and contacts 282 and 286 are prevented form touching. Alternatively, only one of the movable arms 250 or 270 may be blocked so that their respective contacts are prevented from touching. Further, in this embodiment, latching fingers 102 act as an active inhibitor that prevents the contacts from touching. Alternatively, the natural bias of movable arms 250 and 270 can be used as a passive inhibitor that prevents the contacts from touching.

Referring to FIGS. 10 and 15–19, the mechanical components of the circuit interrupting and reset portions in various stages of operation are shown. The description of the operation which follows describes only the phase conductive path, but the operation is similar for the neutral conductive path, if it is desired to open and close both conductive paths. In FIG. 10, the GFCI receptacle is shown in a set position where movable contact arm 250 is in a stressed condition so that movable contact 252 is in electrical engagement with fixed contact 256 of contact arm 254. If the sensing circuitry of the GFCI receptacle senses either a high heat condition or a ground fault, the coil assembly 290 is energized to draw plunger 292 into the coil assembly 290 so that banger 294 moves upwardly. As the banger moves upward, the banger front dog 298 strikes the latch member 100 causing it to pivot in a counterclockwise direction C, see FIG. 15, about the joint created by the top edge 112 and inner surface 114 of finger 110. The movement of the latch member 100 removes the latching finger 102 from engagement with side R of the remote end 116 of the movable contact arm 250, and permits the contact arm 250 to return to its pre-stressed condition opening contacts 252 and 256, see FIG. 15.

After tripping, the coil assembly 290 is de-energized so that spring 293 returns plunger 292 to its original extended position and banger 294 moves to its original position releasing latch member 100. At this time, the latch member 100 is in a lockout position where latch finger 102 inhibits movable contact 252 from engaging fixed contact 256, see FIG. 18. As noted, one or both latching fingers 102 can act as an active inhibitor that prevents the contacts from touching. Alternatively, the natural bias of movable arms 250 and 270 can be used as a passive inhibitor that prevents the contacts from touching.

Figure 15:
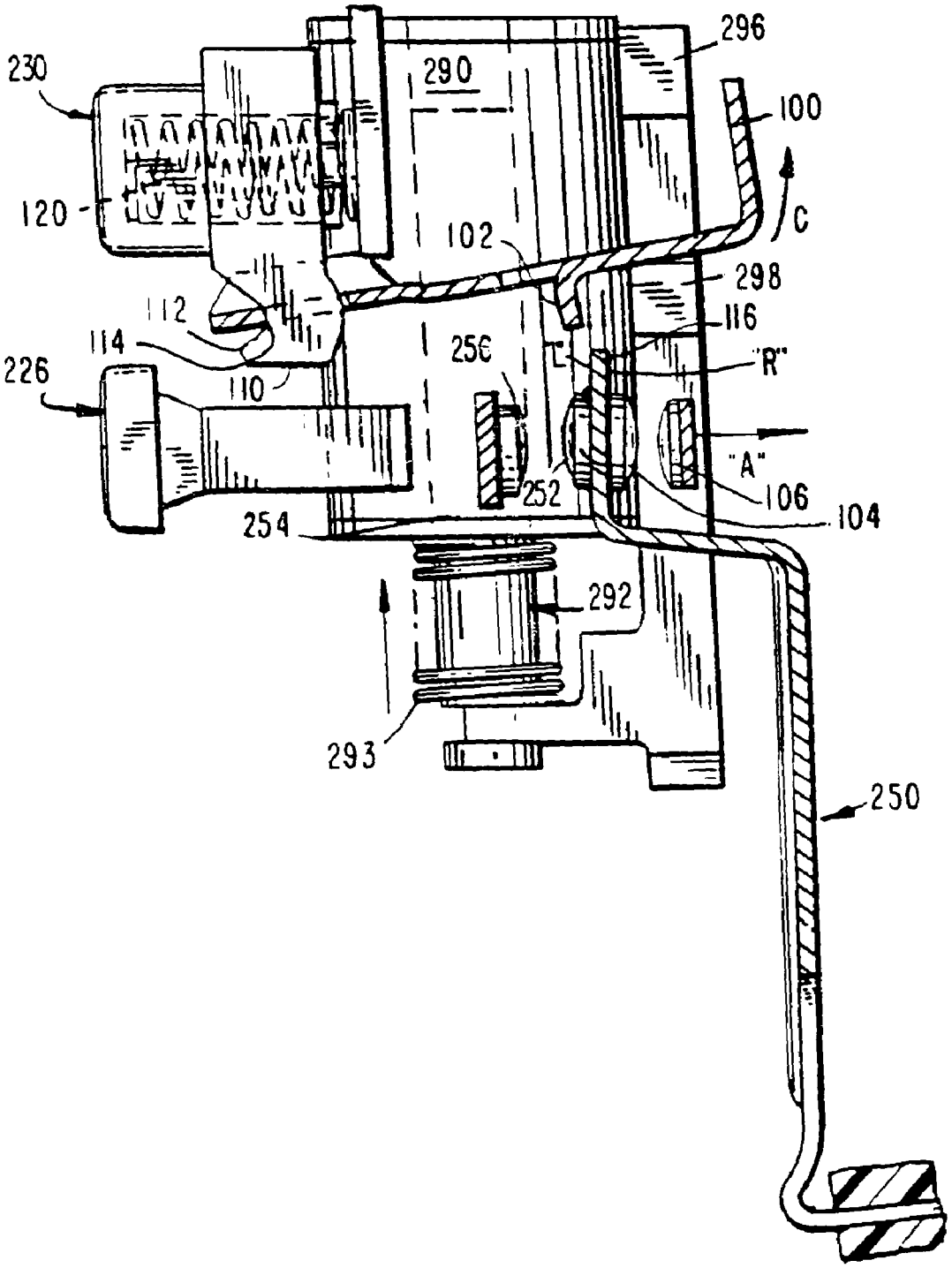
FIG. 15 is a side elevation view similar to FIG. 10 illustrating the GFCI device in a circuit breaking or interrupting position.
Figure 16:
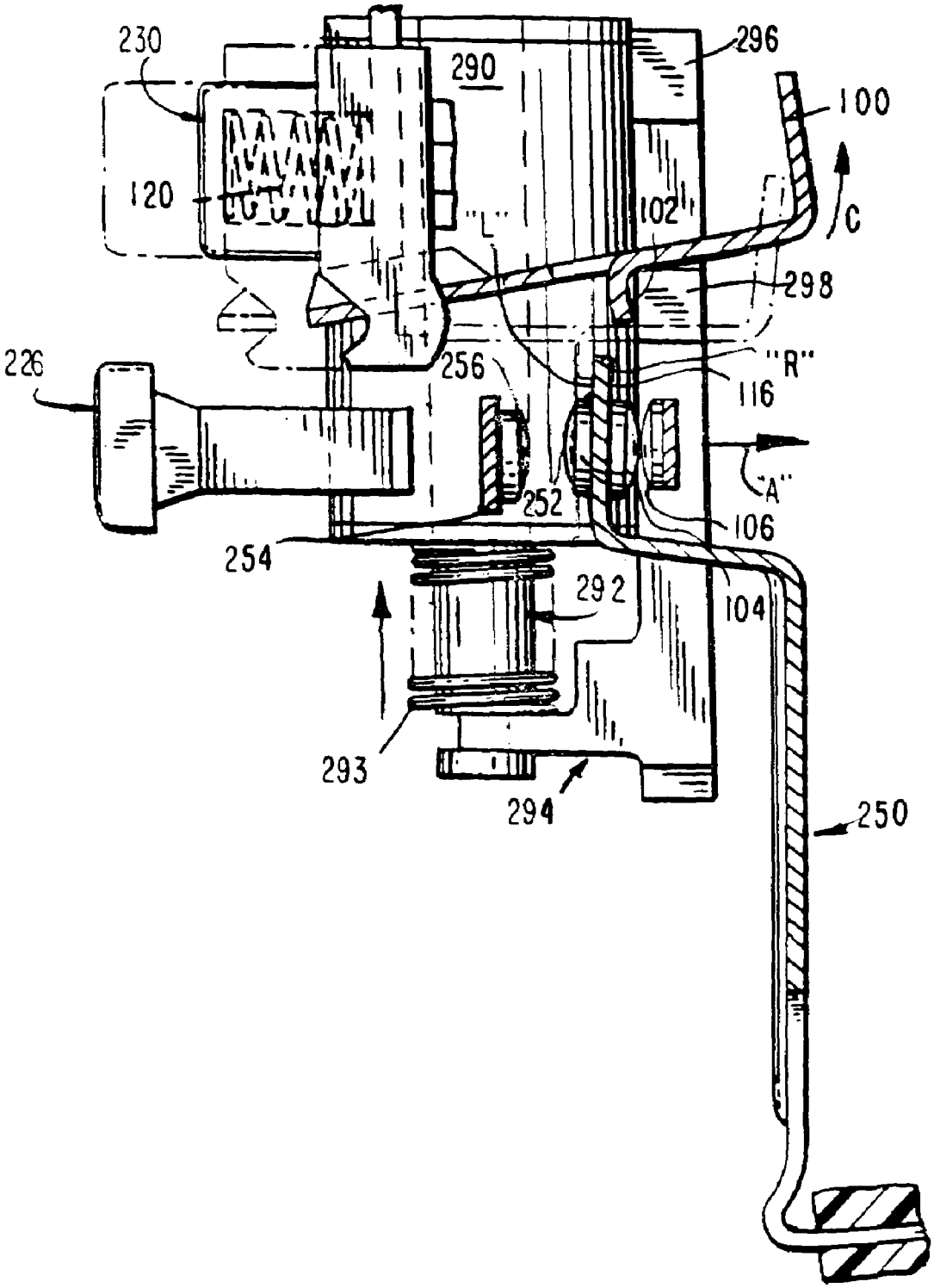
FIG. 16 is a side elevation view similar to FIG. 10 illustrating the components of the GFCI device during a reset operation.
Figure 19:
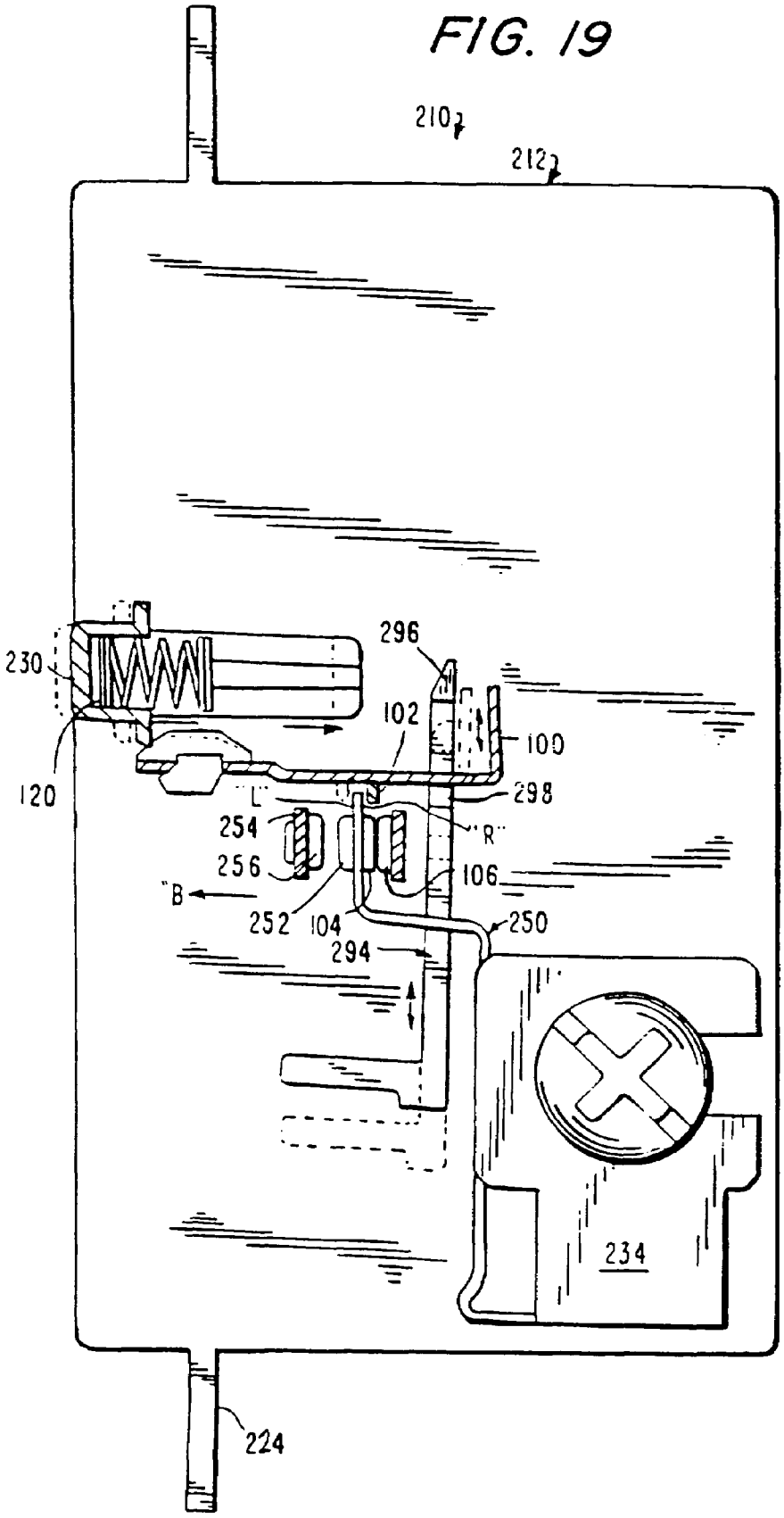

To reset the GFCI receptacle so that contacts 252 and 256 are closed and continuity in the phase conductive path is re-established, the reset button 230 is depressed sufficiently to overcome the bias force of return spring 120 and move the latch member 100 in the direction of arrow A, see FIG. 16. While the reset button 230 is being depressed, latch finger 102 contacts side L of the movable contact arm 250 and continued depression of the reset button 230 forces the latch member to overcome the stress force exerted by the arm 250 causing the reset contact 104 on the arm 250 to close on reset contact 106. Closing the reset contacts activates the operation of the circuit interrupter by, for example simulating a fault, so that plunger 292 moves the banger 294 upward striking the latch member 100 which pivots the latch finger 102, while the latch member 100 continues to move in the direction of arrow A. As a result, the latch finger 102 is lifted over side L of the remote end 116 of the movable contact arm, as seen in FIGS. 15 and 19. Contact arm 250 returns to its unstressed position, opening contacts 252 and 256 and contacts 262 and 266, so as to terminate the activation of the circuit interrupting portion, thereby de-energizing the coil assembly 290.

Figure 17:
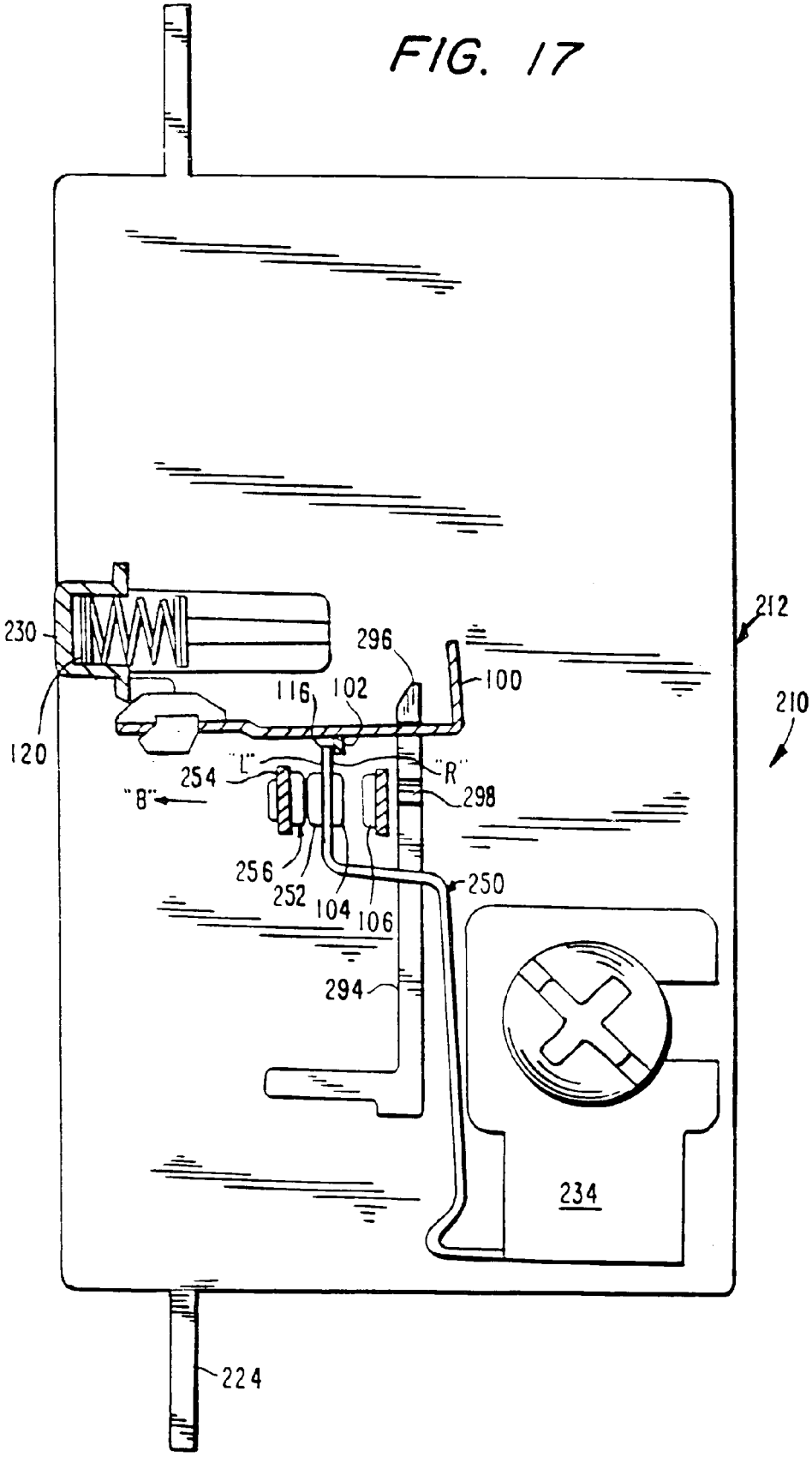
FIGS. 17–19 are schematic representations of the operation of one embodiment of the reset portion illustrating a latching member used to make an electrical connection between line and load connections and to elate the reset portion of the electrical connection with the operation of the circuit interrupting portion.
Figure 18:
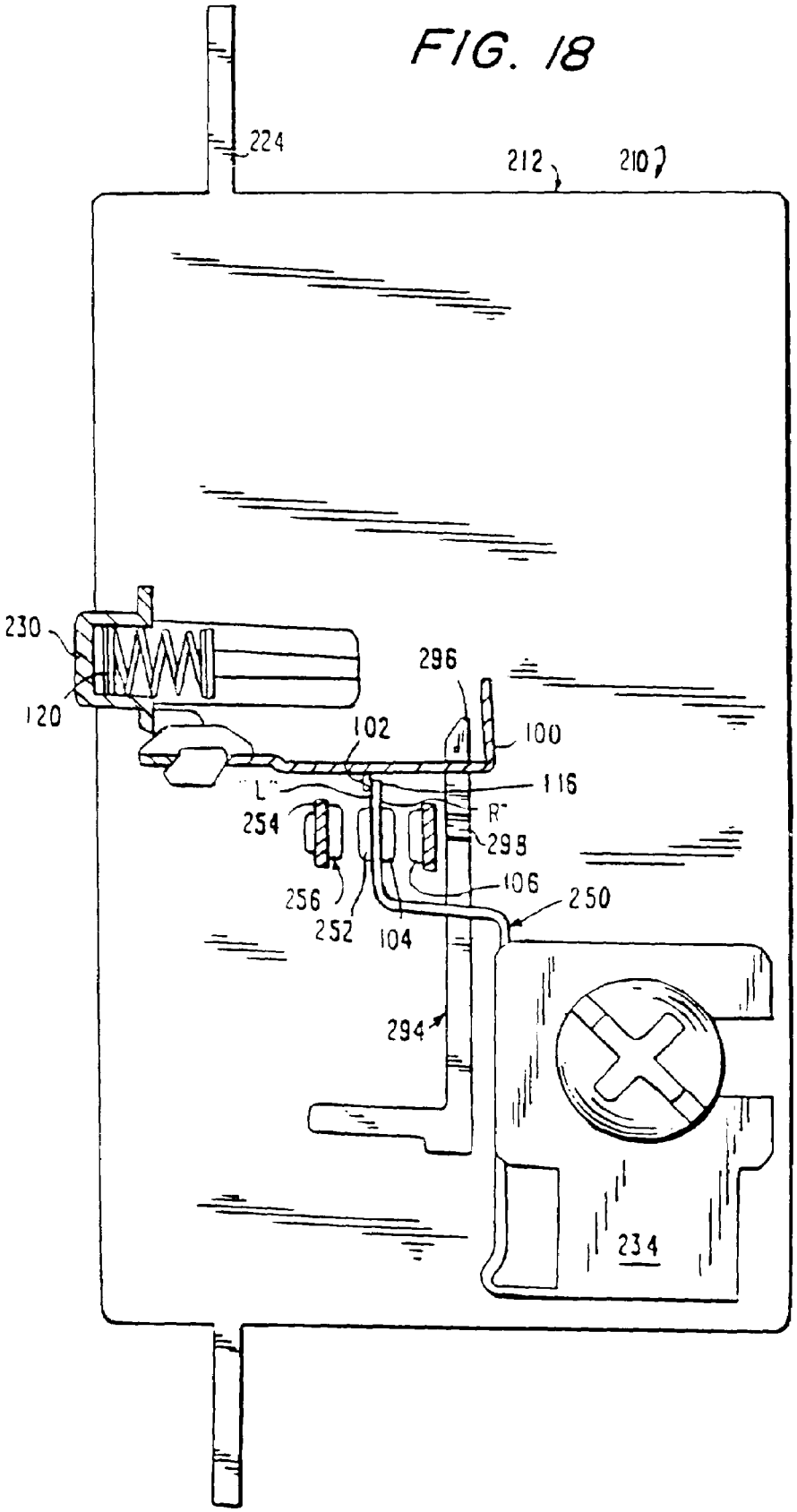

After the circuit interrupter operation is activated, the coil assembly 290 is de-energized so that plunger 292 returns to its original extended position, and banger 294 releases the latch member 100 so that the latch finger 102 is in a reset position, see FIG. 17. Release of the reset button causes the latching member 100 and movable contact arm 250 to move in the direction of arrow B, see FIG. 17, until contact 252 electrically engages contact 256, see FIG. 10.

As noted above, if opening and closing of electrical continuity in the neutral conductive path is desired, the above description for the phase conductive path is also applicable to the neutral conductive path.

In an alternative embodiment, the circuit interrupting devices may also include a trip portion that operates independently of the circuit interrupting portion so that in the event the circuit interrupting portion becomes non-operational the device can still by tripped. Preferably, the trip portion is manually activated and uses mechanical components to break one of more conductive paths. However, the trip portion may use electrical circuitry and/or electromechanical components to break either the phase or neutral conductive path of both paths.

As can be appreciated, circuit interrupters may be designed to provide protection against various faults. For instance, GFCI's generally protect against ground current imbalances. They generally protect against grounded neutrals by using two sensing transformers in order to trip the device when a grounded neutral fault occurs. As can be appreciated, a GFCI may protect against open neutrals. In addition, the GFCI's can also provide protection against reverse wiring. Commonly owned application Ser. No. 09/812,288; Filed Mar. 20, 2001; Publication No. U.S. 2002/0071228 A1 which is incorporated herein in its entirety by reference, describes a family of resettable circuit interrupting devices.

Referring to FIG. 20, there is shown a schematic diagram of an MOV 1000 as disclosed above connected in parallel with and up stream of a circuit for detecting faults.

The over voltage surge protection device here disclosed can also be incorporated within and made a part of an Arc Fault Circuit Interrupter (AFCI). An exemplary embodiment of an AFCI circuit interrupter incorporating a reset lockout will now be described. Generally, each AFCI circuit interrupter according to the present application has a circuit interrupting portion, a reset portion and a reset lockout. Similar to the GFCI circuit interrupter, the circuit interrupting and reset portions use electromechanical components to break (open) and make (close) the conductive path between the line and load phase connections. However, electrical components, such as solid state switches and supporting circuitry, may be used to open and close the conductive path. Similar to the GFCI, the circuit interrupting portion is used to automatically break electrical continuity in the conductive path (i.e., open the conductive path) between the line and load phase connections upon the detection of an arc fault. The reset portion is used to disable the reset lockout and to permit the closing of the conductive path. That is, the reset portion permits re-establishing electrical continuity in the conductive path from the line side connection to the load side connection. Operation of the reset and reset lockout portions is in conjunction with the operation of the circuit interrupting portion so that the electrically conductive path between the line and load phase connections cannot be reset if the circuit interrupting portion is non-operational and/or if an open neutral condition exists.

Similar to the GFCI, the AFCI may also include a trip portion that operates independently of the circuit interrupting portion. An AFCI with the trip portion can still be tripped, i.e., the conductive path between the line and load phase connections can still be opened, even if the circuit interrupting portion becomes non-operational. The trip portion can be manually activated and uses mechanical components to open the conductive path. However, the trip portion may use electrical components, such as solid state switches and supporting circuitry, and/or electromechanical components, such as relay switches and supporting circuitry, to open the conductive path between the line and load phase connections.

The circuit interrupting, reset, reset lockout and optional trip portions are substantially the same as those for the GFCI. A difference between the GFCI and the AFCI is the sensing circuitry used to detect faults. A detailed description of an arc fault sensing circuitry can be found in commonly owned, co-pending application Ser. No. 08/994,772, which is incorporated herein in its entirety by reference. In addition, alternative techniques for sensing arc faults are provided in commonly owned, co-pending application Ser. Nos. 08/993,745; 08/995,130 and 09/950,733, each of which is incorporated herein by reference.

Generally, the sensing circuitry can be configured to monitor the phase conductive path at either the line side of the conductive path, the load side of the conductive path at both the line and load sides of the conductive path. The sensing circuitry can also be configured to implement many of the various techniques capable of monitoring one or more conductive paths and determining whether signals on a conductive path comprise an arc fault. Similar to the GFCI, the sensing circuitry also operates to interrupt the AC power on at least the phase conductive path by opening contacts via actuation of a solenoid.

As noted, although the components used during circuit interrupting and device reset operations are electromechanical in nature, the present application also contemplates using electrical components, such as solid state switches and supporting circuitry, as will as other type of components which may be mechanical in operation and which are capable of making and breaking electrical continuity in the conductive path.

While there have been shown and described and pointed out the fundamental features of the invention, it will be understood that various omissions and substitutions and changes of the form and details of the device described and illustrated and in its operation may be made by those skilled in the art, without departing from the spirit of the invention.

What is claimed is:

1. A protection device comprising:

a ground fault circuit interrupter (GFCI) having phase and neutral line side conductors for connection to a source of current and a load side for connection to a load, wherein said GFCI includes a circuit interrupting portion to automatically break a conductive path between said line side and load side upon detection of a ground fault, a reset portion to break and reset said conductive path, and a reset lockout portion to prevent said GFCI from being reset if said circuit interrupting portion is non-operational; and a surge protection device coupled across said phase and neutral line side conductors of said GFCI, said surge protection device comprising:

a metal oxide varistor (MOV) which increases in temperature when subjected to a voltage spike;

a thermal fusible layer coupled to a surface of said MOV, said thermal fusible layer capable of conducting current and adapted to form a high impedance path by separating, at least partially, or cracking, or sputtering, or melting, from the surface of the MOV when the temperature of the MOV exceeds a predetermined temperature to form of a spark gap electrically connected in series with the MOV to help dissipate voltage surges;

a first conductor having a first end and a second end, said first end coupled directly to a first surface of said MOV and said second end coupled to one of said line side conductors of said GFCI; and a second conductor having a third end and a fourth end, said third end coupled directly to said thermal fusible layer and said fourth end coupled to the other of said line side conductors of said GFCI wherein said first conductor, said thermal fusible layer and said MOV establish a spark gap there between when said thermal fusible layer forms a high impedance path due to heat provided by said MOV as it exceeds said predetermined temperature.

2. The protection device of claim 1 wherein said MOV has a first face and a parallel, spaced apart second face and said thermal fusible layer covers less than the full extent of said first face.

3. The protection device of claim 2 further comprising:

a layer of insulation on said thermal fusible layer; and a connection tail extending from said thermal fusible layer onto said layer of insulation and said second conductor third end is coupled to said thermal fusible layer through said connection tail.

4. The protection device of claim 3 wherein said thermal fusible layer and said layer of insulation are generally concentric and circular.

5. The protection device of claim 1 wherein said thermal fusible layer is rectangular and covers less than the full extent of said surface of said MOV.

6. The protection device of claim 5 further comprising:

a rectangular layer of insulation upon said rectangular thermal fusible layer; and a connection tail extending from said thermal fusible layer onto said layer of insulation and said second conductor third end is coupled to said thermal fusible layer through said connection tail.

7. The protection device of claim 1 wherein said MOV has a first face and a parallel, spaced apart second face and said thermal fusible layer is of a cruciform shape mounted adjacent said first face.

8. A protection device for a metal oxide varistor (MOV) which can protect a ground fault circuit interrupter (GFCI) comprising:

a GFCI having phase and neutral line side conductors for connection to a source of current and a load side for connection to a load, wherein said GFCI includes a circuit interrupting portion to automatically break a conductive path between said line side and load side upon detection of a ground fault, a reset portion to break and reset said conductive path, and a reset lockout portion to prevent said GFCI from being reset if said circuit interrupting portion is non-operational; and a surge protection device coupled across said phase and neutral line side conductors of said GFCI, said surge protection device comprising:

a first semi-circular segment MOV defined by a first straight side edge and a first curved side edge;

a second semi-circular segment MOV defined by a second straight side edge and a second curved side edge;

said first semi-circular segment and said second semi-circular segment generally describing a circular MOV when said first straight side edge is held parallel with said second straight side edge;

said first semi-circular segment MOV and said second semi-circular segment MOV heat up when exposed to voltage spikes;

said first semi-circular segment having a first front surface and a first rear surface, said second semi-circular segment having a second front surface and a second rear surface;

a thermal fusible layer extending between said first semi-circular segment first straight edge surface and said second semi-circular segment second straight edge surface, said thermal fusible layer capable of conducting current there through and adapted to form a high impedance path by separating, at least partially, or cracking, or sputtering, or melting, from the first and second MOV segments when the temperature of the MOV exceeds a predetermined temperature to form a spark gap electrically connected in series with the MOV to help dissipate voltage surges;

a first conductor having a first end and a second end, said first end coupled to one of said first front or first rear surfaces of said first semi-circular segment and said second end coupled to one of said line side conductors of said GFCI; and a second conductor having a third end and a fourth end, said third end coupled to one of said second front or second rear surfaces of said second semi-circular segments and said fourth end coupled to the other of said line side conductors of said GFCI whereby current is permitted to flow through said first straight edge surface of said first semi-circular segment and said second straight edge surface of said second semi-circular segment establish a spark gap there between when said thermal fusible layer forms a high impedance path due to the heat provided by said first and second MOV segments as it exceeds said predetermined temperature.

9. The protection device of claim 8 further comprising;

a layer of insulation surrounding said first front surface, said first curved side surface, said first rear surface, a rear surface of said thermal fusible layer, said second rear surface, said second curved side surface, said second front surface and a front surface of said thermal fusible layer.

10. The protection device of claim 9 wherein said layer of insulation has a top surface and a bottom surface.

11. The protection device of claim 9 further comprising: an air gap extending from said layer of insulation top surface to said bottom surface along one side of said thermal fusible layer.

* * * * *